US008402569B2

(12) United States Patent
Chiang

(10) Patent No.: US 8,402,569 B2
(45) Date of Patent: Mar. 26, 2013

(54) SWIM GOGGLES

(75) Inventor: Herman Chiang, Chung-Ho (TW)

(73) Assignee: Global Esprit Inc., Chung-Ho, Taipei Hsien (TW)

( * ) Notice: Subject to any disclaimer, the term of this patent is extended or adjusted under 35 U.S.C. 154(b) by 344 days.

(21) Appl. No.: 12/835,608

(22) Filed: Jul. 13, 2010

(65) Prior Publication Data

US 2011/0302702 A1 Dec. 15, 2011

(30) Foreign Application Priority Data

Jun. 10, 2010 (TW) ..... 99211106 U

(51) Int. Cl.
*A41D 19/00* (2006.01)

(52) U.S. Cl. ..... 2/442

(58) Field of Classification Search ..... 2/442, 452, 2/429, 440, 428; 24/171, 190, 191, 193, 24/194, 197
See application file for complete search history.

(56) References Cited

U.S. PATENT DOCUMENTS 5,896,588 A * 4/1999 Chiang ..... 2/428

* cited by examiner

*Primary Examiner* — Katherine Moran
(74) *Attorney, Agent, or Firm* — Cheng-Ju Chiang

(57) ABSTRACT

A pair of swim goggles include left and right frames respectively encircling lenses, position elements, and a pair of strap apparatuses assembled with the left and right frames, respectively. Each of the strap apparatuses includes a coupling element, a propping plate, a releasing plate, and a head strap having multiple retaining slots. The coupling element has a base defining an opening therein for receiving the head strap. The propping plate is mounted to the base with one end thereof, and the other end of the propping plate forms a propping wall in the opening and is spaced away from the base. The releasing plate is provided with a pair of guiding walls on opposite sides thereof with respect to two opposite sides of the opening. Each of the guiding walls has a hook portion. An engaging portion is disposed between the guiding walls with respect to the propping wall.

9 Claims, 5 Drawing Sheets

SWIM GOGGLES

BACKGROUND OF THE INVENTION

1. Field of the Invention

The present invention relates to a pair of swim goggles, and particularly to a pair of swim goggles having a simple structure, which are easily and conveniently used.

2. Related Art

Conventional swim goggles, in wearing, are capable of being adjusted by buckles connected to opposite ends of a head strap of the swim goggles for which a wearer usually needs to draw the head strap backwards and forwards within holes of the buckles in order to fit the head strap suitably and comfortably around the wearer's head. Unfortunately, such adjustment is very awkward to handle and is time-consuming. Therefore, improvements are being made to try to overcome such drawbacks, and related inventions are disclosed in TW Utility Model Patent Nos. 91220914, 92216640, 93208471, 93208473, 9421182 and U.S. Pat. Nos.5,956,778, 7,007,311 and so on. Such improvements are directed to swim goggles having a buckle having a press board of a propping portion used for propping against tooth portions of a head strap so as to tighten the head strap, and vice versa, loosen the head strap.

However, in TW Utility Model Patent Nos. 91220914 and 92216640, and U.S. Pat. Nos. 5,956,778 and 7,007,311, the press board thereof has to be returned by physical handling to a position where the head strap is being engaged after the adjustment is done, which causes adjusting processes being inefficient. Although in TW Utility Model Patent Nos. 93208471, 93208473, 94211821, the press board can be returned to the position automatically without physical handling, the buckles have too many components and are too complex to be assembled.

SUMMARY OF THE INVENTION

Accordingly, an object of the present invention is to provide a pair of swim goggles having simple structure, which are easily and conveniently used.

To achieve the above-mentioned objects, a pair of swim goggles include a left and right frames respectively encircling lenses, position elements, and a pair of strap apparatuses assembled with the left and right frames, respectively. Each of the strap apparatuses includes a coupling element, a propping plate, a releasing plate, and a head strap having multiple retaining slots. The coupling element has a base defining an opening therein for receiving the head strap. The propping plate is mounted to the base with one end thereof, and the other end of the propping plate forms a propping wall in the opening and is spaced away from the base. The releasing plate is provided with a pair of guiding walls on opposite sides thereof with respect to two opposite sides of the opening. Each of the guiding walls has a hook portion. An engaging portion is disposed between the guiding walls with respect to the propping wall.

With the above-mentioned structure, the hook portion hooks over a respective side of the base, the propping plate is selectively engaged against one of the retaining slots of the head strap so that the head strap is allowed to move only in one-way direction, and when the releasing plate is pushed in a reverse direction with respect to the one-way direction, the engaging portion is engaged against and moves along the propping wall so that the propping plate is disengaged from said one of the retaining slot, and the head strap is therefore able to be drawn freely.

DESCRIPTION OF THE PREFERRED EMBODIMENTS

Figure 1:
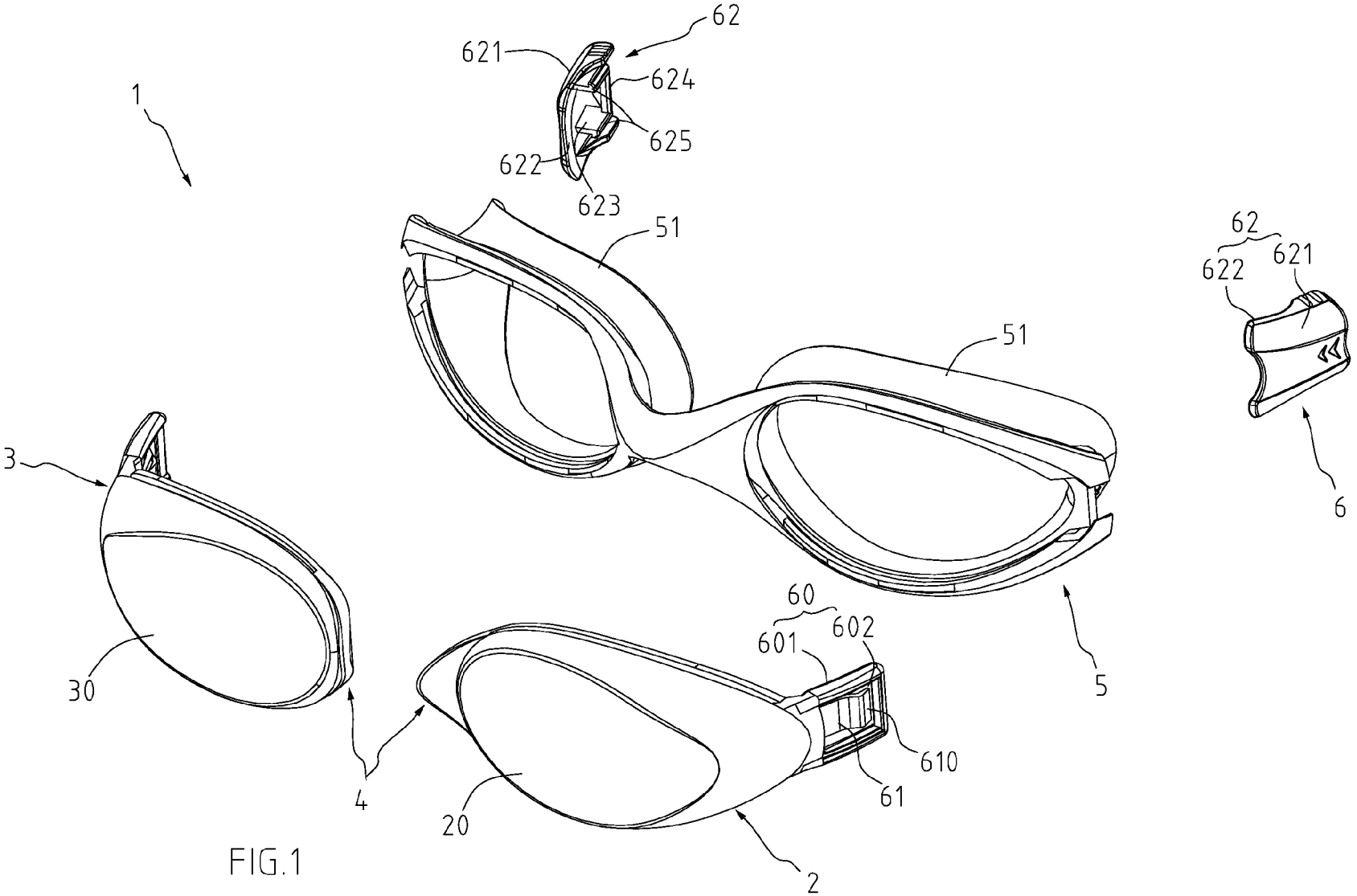
FIG. 1 is an exploded perspective view of a pair of swim goggles of the present invention.
Figure 2:
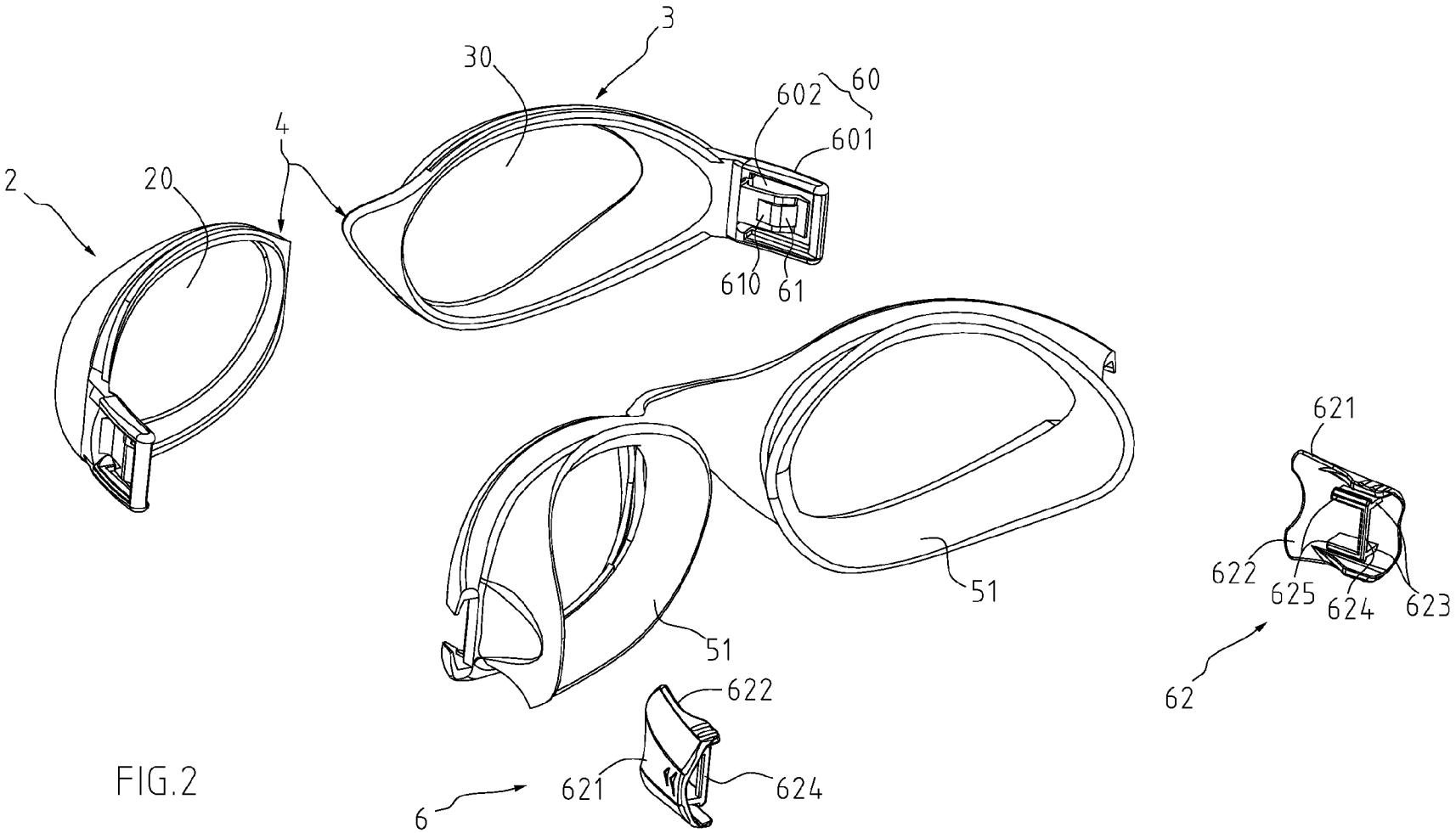
FIG. 2 is another perspective view of FIG. 1.
Figure 3:
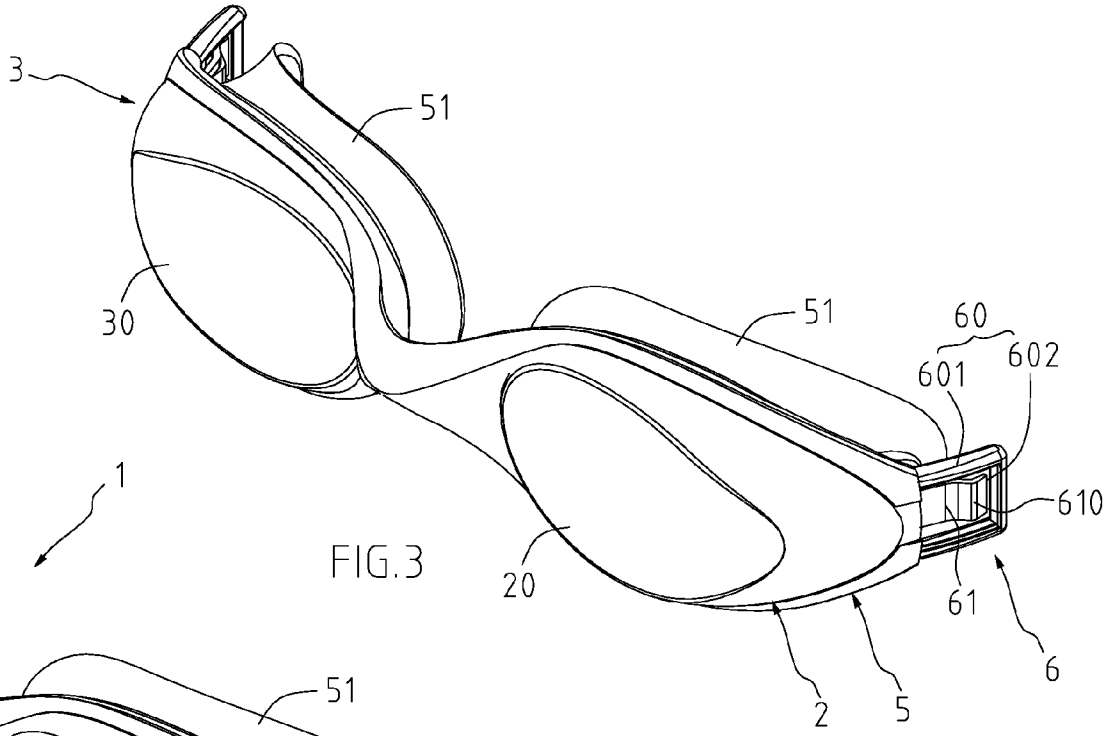
FIGS. 3 and 4 are partially assembly perspective views of FIG. 1.
Figure 4:
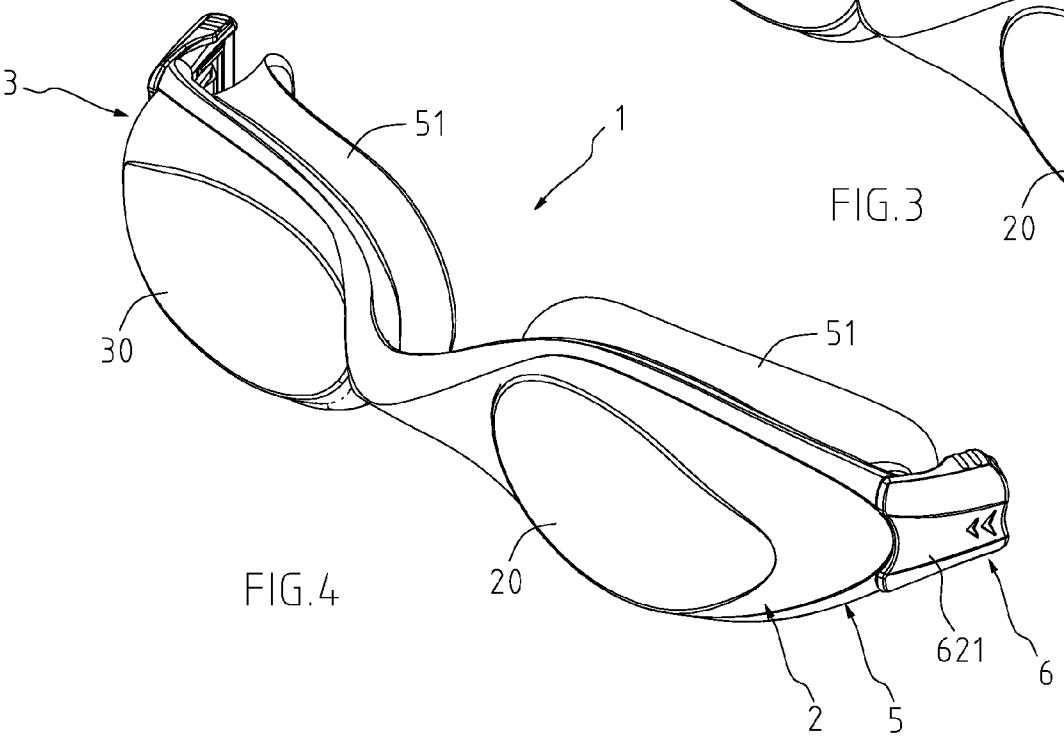
Figure 6:
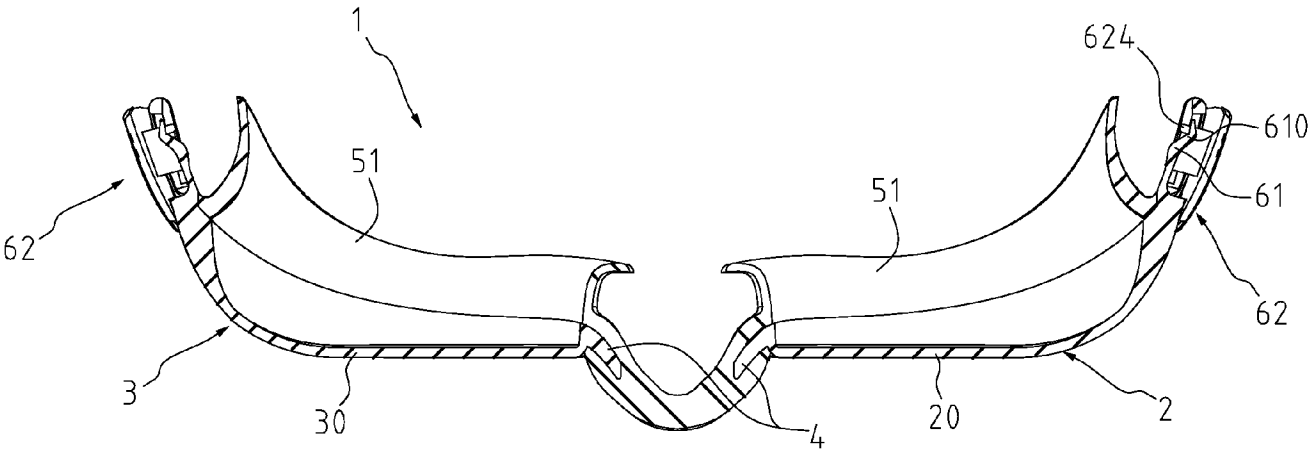
FIG. 6 is a cross-sectional view taken along line 6-6 of FIG. 5.
Figure 5:
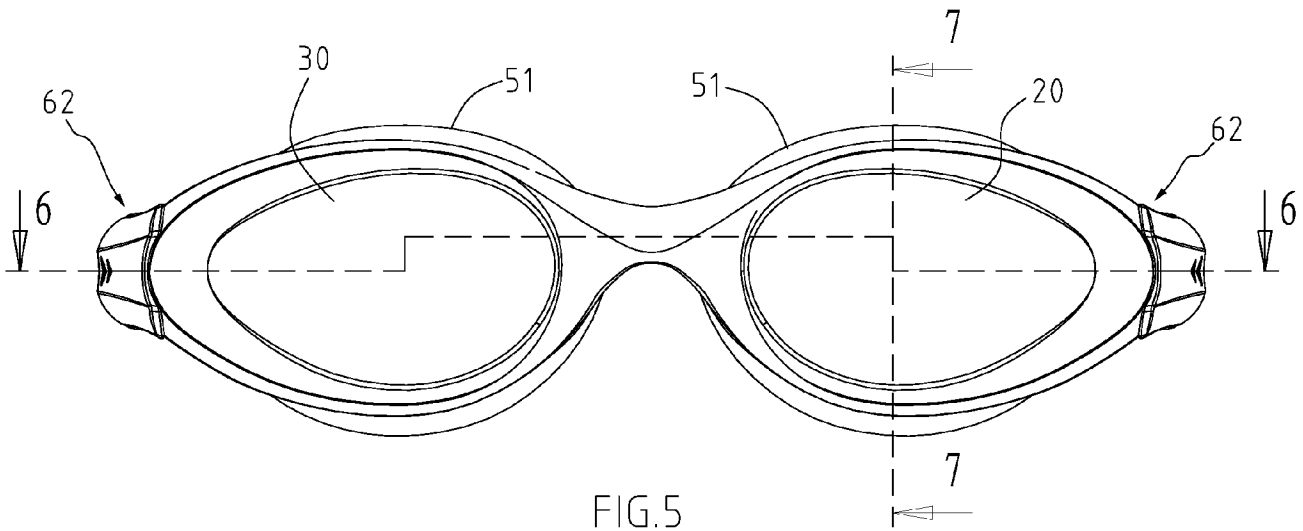
FIG. 5 is a front elevational view of FIG. 4.

Referring to FIGS. 1 to 7, a pair of swim goggles of the present invention include a left frame 2, a right frame 3, position elements 4, a covering frame 5, and strap apparatuses 6, wherein the left and right frames 2, 3 are of same structures and made of Polycarbonate (PC) and integrally encircles lenses 20, 30, respectively. In the present embodiment, the position elements 4 are formed on sides of the left and right frames 2, 3 and preferably spaced away from each other so that each of the position elements 4 extends outwards of the lenses 20, 30, the position elements 4 are connected indirectly when the covering frame 5 made of Thermal Plastic Rubber (TPR) are formed by injection molding integrally with the position elements 4 such that upper and lower sides of the position elements 4 are covered by the covering frame 5, respectively. The covering frame 5 is integrally provided with skirt portions 51 for fitting into a wear's face and eye sockets.

Each of the strap apparatuses includes a coupling element 60, a propping plate 61, a releasing plate 62, and a head strap 63 having multiple retaining slots 631 (referring to FIG. 8), wherein the coupling elements 60 are disposed on outer sides of the left and right frames 2, 3 and have bases 601 defining openings 602 therein for receiving the head strap 63, respectively. The propping plate 61 is mounted to the base 601 with one end thereof, and the other end of the propping plate 61 forms a propping wall 610 in the respective opening 602 and is spaced away from the base 601 such that the propping plate 61 extends transversally in the respective opening 602. The releasing plate 62 has an outer face 621 and an inner face 622 opposite to the outer face 621, the outer face 621 is formed with a rough area (not labeled) and marked with a releasing direction, the inner face 622 is provided with a pair of guiding walls 623 on opposite sides thereof with respect to two opposite sides of the opening 602, respectively; each of the guiding walls 623 has a hook portion 625 on one side thereof, and an engaging portion 624 is disposed between the guiding walls 623 with respect to the propping wall 610. The releasing plate 62 is assembled with the coupling plate 60 by the hook portion 625 which hooks over a respective side of the base 601 through the opening 602.

Figure 8:
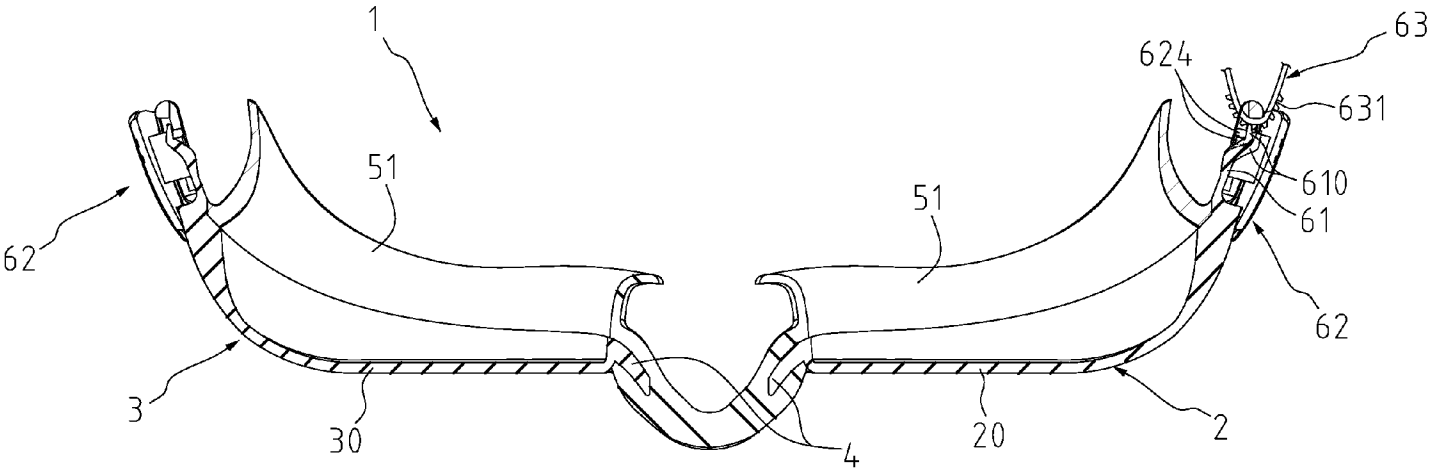
FIG. 8 is schematic sectional view showing a propping plate of a strap apparatus that is being acted so that a part of a head strap is viewed to be drawn freely.
Figure 7:
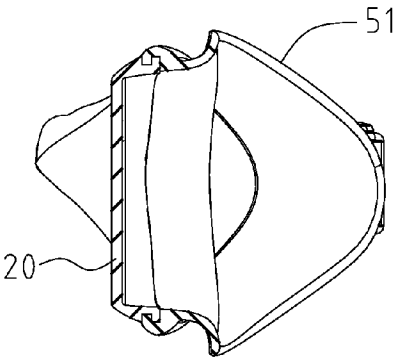
FIG. 7 is a cross-sectional view taken along line 7-7 of FIG. 5.

Further referring to FIG. 8 in combination, the swim goggles 1 of the present invention after assembling, the propping wall 610 of the propping plate 61 is selectively engaging against one of the retaining slots 631 of the head strap 63 so that the head strap 63 is allowed to move only in one-way direction, and when the head strap 63 is to be disengaged, the releasing plate 62 is pushed in a reverse direction with respect to said one-way direction (as the releasing direction marked on the releasing plate 62), the engaging portion 624 is engaged against and moves along the propping wall 610 so that the propping plate 61 is disengaged from said one of the retaining slots 631, and the head strap 63 is therefore able to be drawn freely. When the releasing plate 62 is not being pushed, the propping wall 610 of the propping plate 61 returns to a previous position where the propping wall 610 is selectively engaged against one of the retaining slots 631 due to a restoring force applied to the releasing plate 61 and produced by the pushing.

Accordingly, the pair of swim goggles 1 of the present invention provides a pair of strap apparatuses of simple structure, which is able to be assembled easily and securely, and provides an easy way to adjust length of a head strap so that the swim goggles can be used conveniently and efficiently.

It is understood that the invention may be embodied in other forms within the scope of the claims. Thus the present examples and embodiments are to be considered in all respects as illustrative, and not restrictive, of the invention defined by the claims.

What is claimed is:

1. A pair of swim goggles, comprising left and right frames encircling lenses; position elements formed on sides of the left and right frames, respectively; and a pair of strap apparatuses assembled with outer sides of the left and right frames; wherein each said strap apparatus comprises a coupling element, a propping plate, a releasing plate, and a head strap having multiple retaining slots;

wherein the coupling elements are disposed on the outer sides of the left and right frames and have bases defining openings therein for receiving the head strap, respectively;

the propping plate being mounted to the base with one end thereof, and the other end of the propping plate forming a propping wall in the opening and being spaced away from the base; and the releasing plate having an outer face and an inner face opposite to the outer face, the inner face being provided with a pair of guiding walls on opposite sides thereof with respect to two opposite sides of the opening, respectively; each of the guiding walls having a hook portion on one side thereof, and an engaging portion disposed between the guiding walls with respect to the propping wall;

whereby the hook portion hooks over a respective side of the base, the propping plate being selectively engaged against one of the retaining slots of the head strap so that the head strap is allowed to move only in one-way direction, and when the releasing plate is being continuously pushed in a reverse direction with respect to the one-way direction, the engaging portion is engaged against and moves along the propping wall so that the propping plate is disengaged from said one of the retaining slots, and the head strap is therefore able to be drawn freely.

2. The swim goggles of claim 1, wherein the coupling elements integrally extend outwardly from the outer sides of the left and right frames, respectively.

3. The swim goggles of claim 1, wherein the propping plate integrally extends from the base of the coupling element with one end thereof in the opening of the base.

4. The swim goggles of claim 1, wherein the outer face of the releasing plate is marked with a releasing direction.

5. The swim goggles of claim 2, wherein the left and right frames are integrally formed with the respective lens.

6. The swim goggles of claim 5, further comprising a covering frame made of Thermal Plastic Rubber (TPR) for covering and combining at least upper and lower sides of the left and right frames and the position elements together with the covering frame.

7. The swim goggles of claim 6, wherein the position elements are spaced away from each other and extend outwards of the lenses, respectively.

8. The swim goggles of claim 7, wherein the covering frame is integrally provided with skirt portions.

9. The swim goggles of claim 8, wherein the left and right frames are made of Polycarbonate (PC).

* * * * *